US007219505B2

(12) United States Patent
Weber et al.

(10) Patent No.: US 7,219,505 B2
(45) Date of Patent: May 22, 2007

(54) CONTROL STABILITY SYSTEM FOR MOIST AIR DEHUMIDIFICATION UNITS AND METHOD OF OPERATION

(75) Inventors: Nathan Andrew Weber, Edmond, OK (US); John Terry Knight, Moore, OK (US); Stephen Blake Pickle, Norman, OK (US)

(73) Assignee: York International Corporation, York, PA (US)

( * ) Notice: Subject to any disclaimer, the term of this patent is extended or adjusted under 35 U.S.C. 154(b) by 372 days.

(21) Appl. No.: 10/970,958

(22) Filed: Oct. 22, 2004

(65) Prior Publication Data

US 2006/0086115 A1 Apr. 27, 2006

(51) Int. Cl.
*F25D 25/00* (2006.01)

(52) U.S. Cl. ..... 62/90; 62/176.5; 62/156

(58) Field of Classification Search ..... 62/90, 62/176.5, 238.6, 196.4; 236/44 A, 44 C
See application file for complete search history.

(56) References Cited

U.S. PATENT DOCUMENTS

| | | | | | |
|---|---|---|---|---|---|
| 2,961,844 | A | * | 11/1960 | McGrath | 62/173 |
| 3,105,366 | A | * | 10/1963 | Atchison | 62/173 |
| 3,264,840 | A | * | 8/1966 | Harnish | 62/173 |
| 3,316,730 | A | * | 5/1967 | Lauer | 62/173 |
| 3,402,564 | A | | 9/1968 | Nussbaum | |
| 3,798,920 | A | * | 3/1974 | Morgan | 62/173 |
| 4,018,584 | A | | 4/1977 | Mullen | |
| 4,182,133 | A | | 1/1980 | Haas et al. | |

(Continued)

OTHER PUBLICATIONS

SPORLAN, 3-Way Valves (Installation and Servicing Instructions), Sporlan Valve Company, Washington, MO Jun. 2001 / Bulletin 30-21.

(Continued)

*Primary Examiner*—Cheryl Tyler
(74) *Attorney, Agent, or Firm*—McNees Wallace & Nurick LLC

(57) ABSTRACT

A system and humidity control method is provided for a multi-stage cooling system having two or more refrigerant circuits that balances humidity control and cooling demand. Each refrigerant circuit includes a compressor, a condenser and an evaporator. A hot gas reheat circuit having a hot gas reheat coil is connected to one of the refrigerant circuits and is placed in fluid communication with the output airflow from the evaporator of that refrigerant circuit to provide additional dehumidification to the air when humidity control is requested. The hot gas reheat circuit bypasses the condenser of the refrigerant circuit during humidity control. Humidity control is performed during cooling operations and ventilation operations. During a first stage cooling operation using only one refrigerant circuit and having a low cooling demand, the request for humidity control activates the hot gas reheat circuit for dehumidification and activates a second refrigerant circuit to provide cooling capacity. The hot gas reheat circuit is sized to match the cooling provided by the evaporator so that air cooled by passing through the evaporator can be reheated. Excess refrigerant is passed into the inactive cooling circuit so that proper pressure and temperature can be maintained in the active reheat circuit and so that high head pressure that can damage the compressor can be avoided. During a second stage cooling operation using two or more refrigerant circuit and having a high cooling demand, the request for humidity control is suspended and is initiated only upon the completion of the second stage cooling demand.

43 Claims, 4 Drawing Sheets

U.S. PATENT DOCUMENTS

| | | | | |
|---|---|---|---|---|
| 4,189,929 | A | 2/1980 | Russell | |
| 4,270,362 | A | 6/1981 | Lancia et al. | |
| 4,711,094 | A * | 12/1987 | Ares et al. | 62/90 |
| 4,942,740 | A | 7/1990 | Shawn et al. | |
| 5,065,586 | A | 11/1991 | Shapiro-Baruch | |
| 5,477,697 | A | 12/1995 | Wharton et al. | |
| 5,509,272 | A | 4/1996 | Hyde | |
| 5,622,057 | A | 4/1997 | Bussjager et al. | |
| 5,631,258 | A * | 5/1997 | Borcherding et al. | 514/263.4 |
| 5,651,258 | A | 7/1997 | Harris | |
| 5,823,006 | A | 10/1998 | Jung | |
| 5,992,160 | A | 11/1999 | Bussjager et al. | |
| 6,035,653 | A | 3/2000 | Itoh et al. | |
| 6,055,818 | A | 5/2000 | Valle et al. | |
| 6,272,870 | B1 | 8/2001 | Schaeffer | |
| 6,276,149 | B2 | 8/2001 | Katayama et al. | |
| 6,381,970 | B1 * | 5/2002 | Eber et al. | 62/90 |
| 6,427,461 | B1 | 8/2002 | Whinery et al. | |
| 6,574,976 | B2 | 6/2003 | Takano et al. | |
| 6,612,119 | B2 * | 9/2003 | Eber et al. | 62/90 |
| 6,622,500 | B1 | 9/2003 | Archibald et al. | |
| 6,644,049 | B2 | 11/2003 | Alford | |
| 6,666,040 | B1 * | 12/2003 | Groenewold et al. | 62/173 |
| 6,705,093 | B1 | 3/2004 | Taras et al. | |
| 6,826,921 | B1 | 12/2004 | Uselton | |
| 2004/0089002 | A1 * | 5/2004 | Rayburn | 62/176.1 |
| 2004/0089015 | A1 | 5/2004 | Knight et al. | |
| 2004/0134217 | A1 | 7/2004 | Itoh et al. | |
| 2004/0144111 | A1 | 7/2004 | Matsuoka | |

OTHER PUBLICATIONS

SPORLAN, 3-Way Valves (The Right Solenoid Valve for any Job), Sporlan Valve Company, Washington, MO Jun. 2001 / Bulletin 30-20.

SPORLAN, Type 5D Three-Way Heat Reclaim Valve for Refrigerants 12-22-134a-502, Sporlan Valve Company, Washington, MO Dec. 1995 / Bulletin 30-10-1.

SPORLAN, Solenoid Valves, Sporlan Valve Company, Washington, MO Jan. 1993 / Bulletin 30-10.

* cited by examiner

CONTROL STABILITY SYSTEM FOR MOIST AIR DEHUMIDIFICATION UNITS AND METHOD OF OPERATION

FIELD OF THE INVENTION

The present invention relates generally to controlling refrigerant flow into an air conditioning system having a hot gas reheat circuit, and specifically for controlling the amount of refrigerant flowing into the reheat circuit based on outdoor and indoor ambient conditions.

BACKGROUND OF THE INVENTION

Air delivery systems, such as used in commercial applications, typically are systems that can be used to cool or to accomplish dehumidification when ambient conditions are such that there is no demand for cooling. This demand for dehumidification can often occur on days when the temperature is cool and there is a high humidity level, such as damp, rainy spring and fall days. Under such conditions, it may be necessary to switch the operation of the air delivery system from cooling mode to dehumidification mode.

When switching an air delivery system, such as are used in commercial applications, from the cooling mode to the dehumidification mode in a reheat system that includes a reheat coil and a condenser coil configured in a parallel arrangement, some refrigerant will become trapped in the condenser coil. As the outdoor temperature falls, the amount of refrigerant that becomes trapped in the condenser coil will increase, resulting in a drop in the quantity of refrigeration available in the remainder of the refrigerant system to accomplish dehumidification. Without adequate refrigerant in the dehumidification circuit, operational problems will occur with the air delivery system. Some refrigerant can become trapped in a system that includes a reheat circuit even on warm days when dehumidification is required, but cooling is not required. The refrigerant can become trapped in the condenser coil, and if switching is required to the cooling mode, additional refrigerant can be trapped in the reheat circuit.

One of the problems is decreased system capacity as the refrigerant normally available in a properly operating system is trapped in the condenser coil and not available to the compressor. Associated with this problem is inadequate suction pressure at the compressor, since the gas refrigerant that normally is available to the compressor from the evaporator is trapped as a liquid in the condenser. A solution to the problem of refrigerant trapped as a liquid in a condenser or in a reheat heat exchanger is set forth in United Stated Patent Application No. U.S. 2004/0089015 A1, based on U.S. Ser. No. 10/694,316 to Knight et al., filed Oct. 27, 2003, now allowed, ("the Knight application") and assigned to the assignee of the present invention, which allowed application is incorporated herein by reference.

The system described in the Knight application utilizes a system having a reheat circuit in which a hot gas reheat exchanger is coupled to an evaporator and a compressor, but which does not include a condenser. A separate cooling circuit utilizes a compressor, a condenser and an evaporator. The evaporator and compressor may be shared between the two circuits, when suitable valving is used to isolate the circuits. As discussed in the Knight application, the system may be combined with additional cooling circuits, as required. Thus, systems having more than one compressor are envisioned, and these compressors also may be coupled to additional reheat circuits. Although such complex systems are envisioned by the Knight application and the present invention, both the Knight application and the present invention are readily understood without reference to these more complex arrangements, as one skilled in the art can readily adapt the simpler concepts of the Knight application and the present invention to such complex arrangements.

In order for the reheat circuit to operate efficiently and properly, the hot gas reheat exchanger must be suitably sized in relation to the evaporator. Generally, the properly sized hot gas reheat exchanger is smaller than the condenser that is included in the cooling circuit that shares the same condenser and evaporator. The result is that when the cooling circuit is inactivated and the reheat circuit is activated to accomplish dehumidification, excess refrigerant can be directed into the reheat circuit. The Knight application, while implicitly recognizing the need to balance the size of the hot gas reheat coil against the size of the evaporator coil, explicitly addresses the problem of refrigerant, which is also shared by the cooling circuit and the reheat circuit, trapped in the inactivated circuit. However, it fails to address the problem of refrigerant being drawn into the activated circuit. Excess refrigerant drawn into a circuit can result in operational problems which should be avoided. One of these problems is unacceptable discharge pressures from the compressor, which can lead to decreased system efficiency. If the amount of excess refrigerant drawn into the activated circuit is too great, slugging can also be a problem. Slugging is a condition in which liquid refrigerant is drawn into the compressor. These operational problems can result in a severe reduction in compressor life, and in the worst circumstances, to premature compressor failure.

What is needed is a system that can readily and rapidly accommodate the difference in refrigerant capacity between the reheat circuit and the cooling circuit to avoid these operational problems without having to resize or otherwise reengineer the hot gas reheat coil or the condenser coil.

SUMMARY OF THE INVENTION

The present invention utilizes a system having an independent hot gas reheat circuit and a cooling circuit. The hot gas reheat circuit includes a compressor, an evaporator and a hot gas reheat coil. The hot gas reheat coil is engineered to work in conjunction with the evaporator to provide a sufficient rise in temperature of air that has been cooled after passing over the evaporator. The cooling circuit, which is isolable from the reheat circuit, includes a condenser, and shares the compressor, the evaporator and refrigerant with the reheat circuit. The hot gas reheat coil is generally sized to accommodate sufficiently less refrigerant than the condenser.

The present invention controls the amount of refrigerant entering into a first circuit from a second circuit, wherein the first circuit is being activated and the second circuit is being inactivated. This control is of particular importance when the activated circuit has less refrigerant capacity than the inactivated circuit.

The present invention accomplishes the control of the amount of refrigerant entering a first circuit that is activated from a second circuit that is inactivated by utilizing a plurality of valves that operate in response to a monitored environmental condition. When the sensed, monitored environmental condition is outside of predetermined limits, the valves operate to move refrigerant into the inactivated circuit, thereby utilizing the inactivated circuit as a storage area. In this manner, the inactivated circuit can be utilized as a receiver for the excess refrigerant.

As noted above, the engineering of most systems results in a hot gas reheat coil that has less refrigerant capacity than the condenser coil. Thus, the system of the present invention, as a minimum, should, when the reheat circuit is activated, monitor an environmental condition, such as system pressure, and utilize the condenser coil as a receiver for excess refrigerant when the monitored pressure is outside of predetermined limits. Excess refrigerant is the difference in refrigerant capacity , the excess refrigerant being the amount of refrigerant that should be removed for the circuit having lesser capacity in order to maintain satisfactory and efficient operation of the circuit. However, the system is not so limited, and can be engineered so that when the cooling circuit is activated, the inactivated hot gas reheat coil can be utilized as a receiver for excess refrigerant if the monitored environmental condition is outside of predetermined limits, if required. The present invention moves the excess refrigerant out of the circuit, here the reheat circuit when activated. While an accumulator of the prior art stores refrigerant, the refrigerant is still present in the circuit. So the present invention, while eliminating the need for an accumulator, does not substitute the inactive circuit for the accumulator as a reservoir for excess refrigerant. The present invention physically moves the excess refrigerant from the active circuit to an inactive circuit. By doing so, the operating temperature of the evaporator, that is the evaporation temperature of the refrigerant in the evaporator, can be controlled for efficient operation. This is monitored and manipulated in the present invention by controlling the refrigerant pressure in the active circuit, although any other monitoring method may be utilized.

An advantage of the present invention is that refrigerant is not inadvertently trapped in the inactivated circuit, but is initially moved from the inactivated circuit into the activated circuit, and then is metered from the activated circuit back to the inactivated circuit based on sensed environmental conditions that exceed predetermined limits. In this way, the proper amount of excess refrigerant can be moved into the inactivated circuit. Stated alternatively, the proper amount of refrigerant is metered into the active circuit based on sensed environmental or operating conditions in the active circuit.

Another advantage of the present invention is that, by using the inactivated circuit for storage of the excess or unneeded refrigerant, the accumulator can be eliminated.

Another advantage of the present invention is that by adjusting the amount of refrigerant in the activated circuit, proper system control can be maintained. Specifically, the compressor pressure range for maximum capacity and efficiency can be maintained. The refrigerant evaporation temperature, which is related to the pressure, also can be controlled for efficient dehumidification. This translates to energy savings for the operator or owner.

A related advantage to maintaining compressor operational pressures within design pressures and avoiding the fluctuations in pressure that occur as a result of excess refrigerant is extended compressor life. Premature compressor failure as a result of events such as slugging can be avoided.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
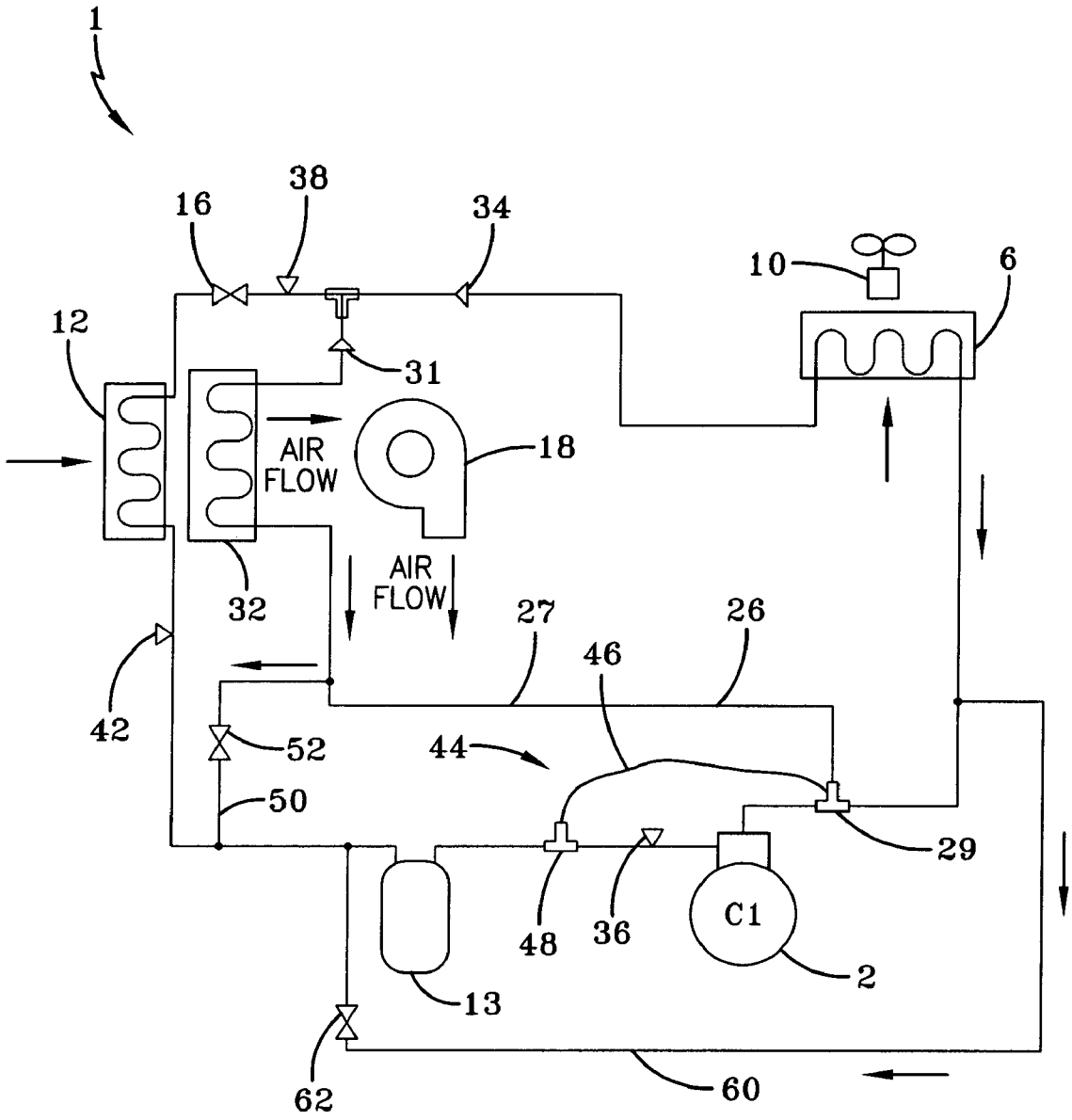
FIG-1 PRIOR ART
FIG. 1 illustrates a schematic of a prior art single compressor system having a cooling circuit and a reheat circuit.

FIG. 1 illustrates a prior art single compressor circuit. This system is set forth in United Stated Patent Application No. U.S. 2004/0089015 A1, based on U.S. Ser. No. 10/694,316 to Knight et al., filed Oct. 27, 2003, now allowed, ("the Knight application") and assigned to the assignee of the present invention, which allowed application is incorporated herein by reference. This system includes a reheat circuit and a cooling circuit which operate independently. In operation, the prior art system of FIG. 1 includes the usual components of a cooling system circuit, a compressor 2, connected by conduit to a condenser 6 which is connected by conduit to an evaporator 12, which is connected by conduit to compressor 2. In the cooling mode, refrigerant sealed in system 1 is compressed into a hot, high-pressure gas in compressor 2 and flows through conduit to condenser 6. The condenser having a heat exchanger or coil 6, includes a fan 10 which blows air across the condenser coil 6. In the condenser, at least some of the hot, high-pressure gas refrigerant undergoes a phase change and is converted into a fluid of high-pressure refrigerant liquid or a fluid mixture of high-pressure refrigerant liquid and refrigerant vapor. In undergoing the phase change, the refrigerant transfers heat through the coils of the condenser to the air passing over the coils with the assistance of fan 10. Additional heat, heat of condensation, is given off by the refrigerant as it condenses from a gas to liquid. The high-pressure fluid passes through a conduit to an expansion device 16. As the fluid passes through expansion device 16, it expands, flashing some of the liquid to gas and reducing the fluid pressure. The low-pressure fluid then passes to the evaporator 12. In evaporator 12, the refrigerant passes through the evaporator heat exchanger circuits where the liquid refrigerant undergoes a second phase change and is converted to a vapor. This conversion requires energy, provided in the form of heat, which is drawn from air passing over the evaporator coils. This airflow is assisted by a fan which forces air over the coils. As shown in FIG. 1, the air is drawn over the coils by an air circulating means, indoor blower 18 in FIG. 1. After passing over the evaporator heat exchanger circuits, the air, which is now cooler as heat has been absorbed from it to assist in the refrigerant phase change, can be supplied to the space that requires refrigeration. Of course, the ability of the cooled air supplied to the space to hold moisture in the form of humidity is reduced below its capacity when it passed over the evaporator heat exchanger circuits, so the air passing into the space is also dehumidified. The excess moisture is removed from the air as condensate as it passes over the heat exchanger circuits and is directed to a drain. The refrigerant gas, now at low-pressure and low temperature is returned to compressor 2. As shown in FIG. 1, there is an accumulator 13, which stores any excess liquid refrigerant and lubricant until a system demand calls for it. A suction line circuit 44 includes a bleed line 46. The line 46 runs from suction line 42 to valve 29 to activate or inactivate valve 29 in response to a signal from a controller (not shown). The prior art system also includes a reheat circuit.

This prior art unit also includes a reheat circuit. The reheat circuit includes compressor 2, reheat exchanger 32, and an evaporator 12. Although the reheat circuit shares the compressor 2 and the evaporator 12 with the cooling circuit, the reheat circuit and the cooling circuit are independent circuits. This means that the circuits run as independent loops. To that end, backflow valves or check valves 31, 34 are included to maintain the operation of the circuits as independent loops. In operation, valve 29 is switched to direct hot refrigerant gas from the compressor discharge to the reheat coil 32. The refrigerant gas is directed through expansion device 16 where the refrigerant is expanded and the pressure is reduced. The refrigerant is prevented from back flowing to condenser coil 6 by check valve 34. As when the cooling mode is activated, air circulated through the evaporator is cooled and dehumidified. However, to return the air to the space or room at the same temperature, it passes through the reheat coil 32 where it is reheated. As will be appreciated by those skilled in the art, in order for the reheat coil or reheat heat exchanger 32 to properly reheat the cooled air, it is engineered to the proper size so that the proper heat balance between the evaporator 12 and the reheat coil 32 can be achieved to properly reheat the cooled, dehumidified air. It will also be appreciated that if the reheat coil is too small, excessive head pressure can result, leading to compressor failure.

The prior art reheat circuit utilizes a reheat refrigerant recovery circuit 60 and a condenser refrigerant recovery circuit 60 to prevent unused refrigerant from becoming entrapped in the inactivated circuit. When unused refrigerant is trapped in the inactive circuit, system efficiency drops. If a large quantity of refrigerant is entrapped in the inactive circuit, damage to the compressor can result. To prevent this situation, the reheat circuit is connected to the suction side of the compressor by reheat refrigerant recovery circuit 50 and the cooling circuit is connected to the suction side of the compressor by condenser refrigerant recovery circuit 60. When a circuit is inactivated, either the cooling circuit or the reheat circuit, a controller opens a valve (52 for the cooling circuit, 62 for the reheat circuit) and the suction of the compressor draws any refrigerant trapped in the evaporator 12 or the reheat coil 32 out of the inactive circuit. Any excess refrigerant is stored in an accumulator 13.

Because of typical size constraints in the unit cabinet, the reheat coil 32 is rarely, if ever, the same size as the condenser coil 6. The condenser coil 6 is typically larger than the reheat exchanger 32. Thus, the cooling circuit may require more refrigerant to operate efficiently than does the reheat circuit. While this solution prevents the entrapment of refrigerant in the inactivated circuit, a problem exists when switching from the one circuit to the other. This problem exists when switching from the circuit having the larger heat exchanger, typically the cooling circuit having condenser coil 6, to the system having the smaller heat exchanger, typically the reheat coil 32. Specifically, upon switching, the system may place excess refrigerant into the circuit having the smaller heat exchanger. This in turn can result in the system operating at too high of a pressure, as discussed above.

Figure 2:
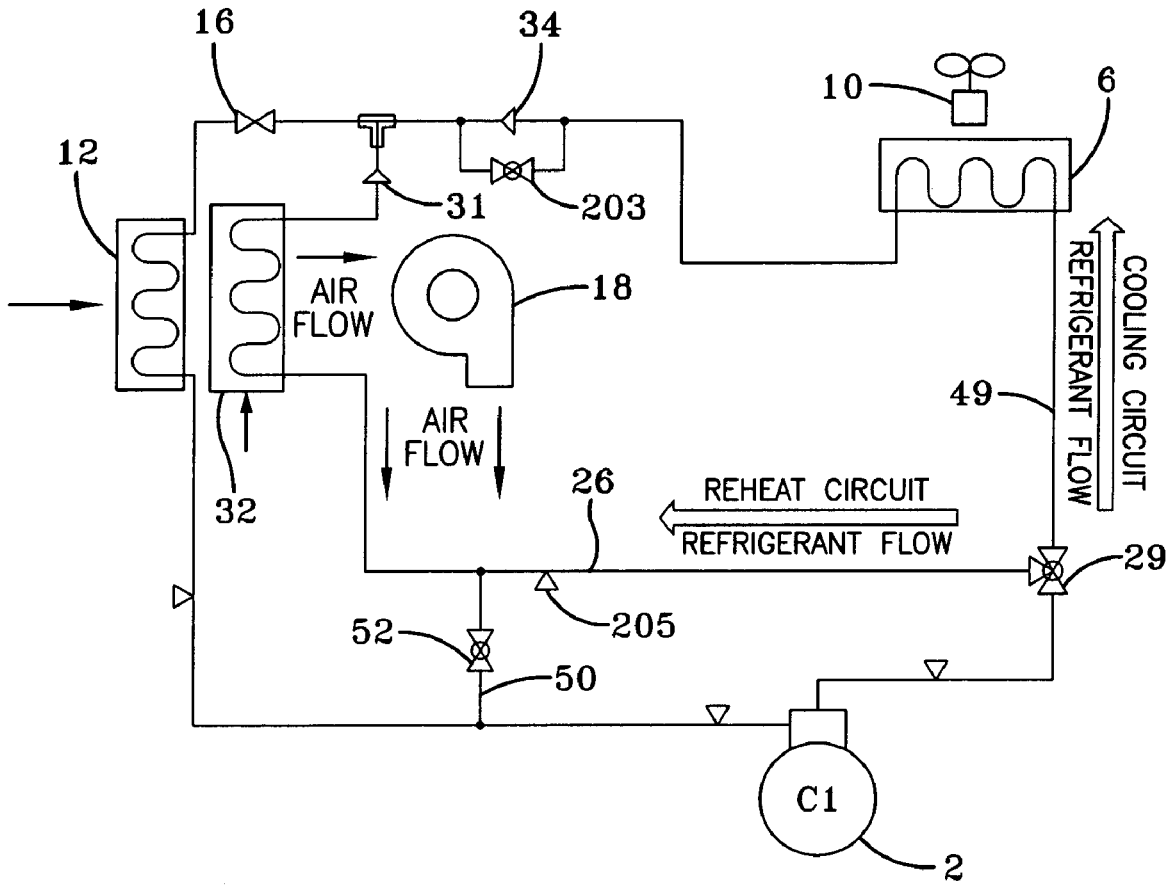
FIG. 2 is a schematic illustration of the present invention depicting control of the circuits utilizing solenoid valves to channel excess refrigerant into the inactive circuit.

Referring now to FIG. 2, the present invention prevents excess refrigerant from being supplied to a circuit that has just been activated. The present invention includes a first solenoid valve 52 between reheat circuit and the suction side of compressor 2. The first solenoid valve 52 is controlled by a controller (not shown in FIG. 2). A second solenoid valve 203 is positioned between the condenser coil 6 and the reheat coil 32 to allow refrigerant to by-pass check valve 34 after it has flowed through reheat coil 32. Three-way valve 29 controlled by a controller, operates to direct hot, high pressure refrigerant discharged by compressor 2 to either the cooling circuit and condenser coil 6 or to the reheat circuit and reheat coil 32.

When the system is switched by the controller to the cooling mode, hot, high pressure refrigerant is directed by three-way valve 29 into the cooling circuit 49, three-way valve 29 closing to block the flow of the refrigerant into hot gas reheat circuit 26. Substantially simultaneously with the opening of three-way valve 29 to permit flow of refrigerant into cooling circuit 49, the controller sends a signal opening solenoid valve 52, thereby activating reheat refrigerant recovery circuit 50. The suction of the compressor 2 thus draws any refrigerant that may have been trapped in reheat coil 32 from coil 32 and into cooling circuit 49. No accumulator is required for this operation, as cooling circuit 49 requires substantially all of the refrigerant in the system for efficient operation as condenser coil 6 is larger than reheat coil 32. The cooling circuit 49 operates in the conventional way. The hot, high pressure refrigerant is pumped through a conduit to condenser coil 6, where it is converted from a gas to substantially a high pressure liquid, and it transfers heat to air forced across it by fan 10. The cooled, liquid refrigerant then flows through a thermal expansion device 16 which reduces the pressure of the liquid. Flow into reheat circuit 26 is prevented by check valve 31. After the refrigerant passes through expansion device 16, it then flows into evaporator 12 where it undergoes a second change of state from liquid to gas. Heat is absorbed from the air passing through the circuits of evaporator 12. To facilitate this change of state, an air circulating means, such as a blower 18 utilized. The air is also dehumidified and the refrigerant then flows back to compressor 2 where the cycle is repeated.

When the controller switches to a reheat mode, three-way valve 29 is signaled to switch the flow of refrigerant from the cooling circuit 49, which is closed, to hot gas reheat circuit 26 in the direction of the arrow shown between compressor 2 and reheat coil 32. The controller makes this determination based on the temperature and humidity of the space that is being controlled. If the sensors in the room indicate that the temperature is sufficiently cool, but that the humidity remains above a preselected level, such a switch will be accomplished. In a system that utilizes more than one compressor or more than one cooling circuit, if the controller determines that maximum cooling is not required, but that additional cooling and dehumidification are required, the hot gas reheat circuit 26 will be activated simultaneously with the operation of one or more cooling circuits controlled by additional compressors in the system. Solenoid valve 203 is responsive to reheat high-pressure device 205. When this device 205 indicates that the compressor discharge pressure is above a preselected level, device 205 causes second solenoid valve 203 to open. Since solenoid valve 203 bypasses check valve 34, at least some refrigerant, after flowing through reheat coil 32, is directed into condenser coil 6. As the pressure initially increases in the reheat circuit, check valve 34 will be closed and refrigerant will flow through solenoid valve 203, When reheat high pressure device 205 indicates that the compressor discharge pressure has stabilized at or below a preselected level, solenoid valve 203 is closed and further flow of refrigerant into condenser circuits 6 is blocked. The remaining refrigerant circulates through the hot gas reheat circuit 26. Because the amount of refrigerant in the hot gas reheat circuit 26 is regulated by the compressor discharge pressure, problems arising from excess refrigerant in hot gas reheat circuit 26 are eliminated. Excess refrigerant is stored out of the reheat circuit and in condenser circuits 6, which serves as a receiver, and the accumulator of the prior art may be eliminated. However, the condenser circuits are not merely a substitute for the prior art accumulator. When the accumulator is used, the refrigerant remains stored within the circuit, but is otherwise available to the compressor and can lead to excessive pressures. When the condenser circuits are used to store the excess refrigerant, the refrigerant is removed from the reheat circuit and is not available to the circuit while it remains in the reheat mode. Furthermore, when the cooling circuit is activated and the reheat circuit is inactivated, the additional refrigerant required by the cooling circuit is already located in the cooling circuit, being stored in the condenser circuits 6. In addition to eliminating the accumulator, set forth in the prior art, the system also eliminates condenser refrigerant recovery circuit and its associated solenoid valve and conduits.

Reheat high pressure device 205 may be any control device that can control solenoid valve 203. For example, reheat high pressure device 205 may be a switch that has settings. When a first preselected pressure setting is reached and is detected by switch 205, the switch closes and sends a signal to open solenoid valve 203. Solenoid valve 203 remains open until a second preselected pressure setting is reached. The second preselected pressure setting may be the same as the first preselected pressure setting or it may be a lower pressure. When the pressure drops below a second preselected pressure setting, the switch opens, removing the signal, thereby closing solenoid valve 203. In another embodiment, reheat high pressure device 205 may be a sensor that senses the refrigerant discharge pressure from compressor 2. The reheat sensor is in communication with the controller, not shown in FIG. 2, which is programmable. The preselected pressure can be programmed into the controller. When the pressure measured by the sensor 205 exceeds or falls below a preselected setting, the controller, which is constantly monitoring sensor 205, sends a signal to change the status of solenoid valve 203. For example, if the preselected pressure setting programmed into the controller is, for example 225 psig, and the pressure detected by sensor 205 exceeds this value, a signal is sent by the controller that opens solenoid valve 203. The opened valve permits refrigerant to bypass check valve 34 and flow into condenser coil 6. As refrigerant flows into condenser coil 6, less refrigerant remains in reheat circuit 26 and the discharge pressure from compressor 2 begins to decrease. When the discharge pressure reaches a second preselected pressure, either at or below the first preselected pressure, the controller, which is monitoring the pressure at sensor 205, sends a signal to close solenoid valve 203. Thus if the second pressure is, for example, 180 psig, then the controller sends a signal that closes second solenoid valve 203, stopping the flow of refrigerant fluid through solenoid valve 203 and around check valve 34. The reheat circuit should now be stabilized, operating at a capacity that is within a pressure range that produces the required reheat for balancing temperature. If the system should become unstable, the reheat high-pressure device 205 will detect the change in pressure and adjust the pressure by channeling additional refrigerant into condenser 6 by repeating this process.

When the system is switched over to the cooling mode, such as for example, if there is a call for maximum cooling, three-way valve 29 switches to direct the compressor discharge into cooling circuit 49 in the direction of the arrow shown between compressor 2 and condenser coil 6, stopping the flow of refrigerant into hot gas reheat circuit 26. This circuit requires additional refrigerant to operate efficiently, but the refrigerant is already properly stored within condenser 6. This refrigerant should already be condensed, and the pressure differential caused by compressor suction and compressor discharge will result in the flow of condensed refrigerant to the evaporator.

While the system illustrated in FIG. 2 depicts reheat pressure device 205 positioned in the conduit of reheat circuit between three-way valve 29 and reheat coil 32 so as to monitor high pressure discharge from the compressor, it will be recognized by one skilled in the art that reheat pressure device 205 may be positioned anywhere in the active circuit to monitor the pressure of refrigerant at a preselected location within the circuit.

One skilled in the art therefore will understand that reheat pressure device 205 may be a low-pressure device. In this embodiment, the reheat pressure device is positioned in the suction line between the evaporator 12 and the suction port of compressor 2, on the low pressure side of the compressor, to monitor the pressure of the refrigerant returning to the compressor. Second solenoid valve 203 is cycled based on preselected pressure settings as before. When the detected pressure is above a first preselected limit, the valve is opened until the pressure falls below a second preselected limit, which may be the same as, or lower than the first preselected limit. This arrangement is an equivalent arrangement to the arrangement using reheat pressure device 205 on the high pressure or discharge side of the compressor. When the reheat pressure device 205 is located on the discharge or high pressure side of the compressor, it may be referred to as a reheat high-pressure device, and when it is located on the suction or low pressure side of the compressor, it is referred to as low-pressure device, the designations simply indicating the location of pressure device 205 within the circuit.

Figure 3:
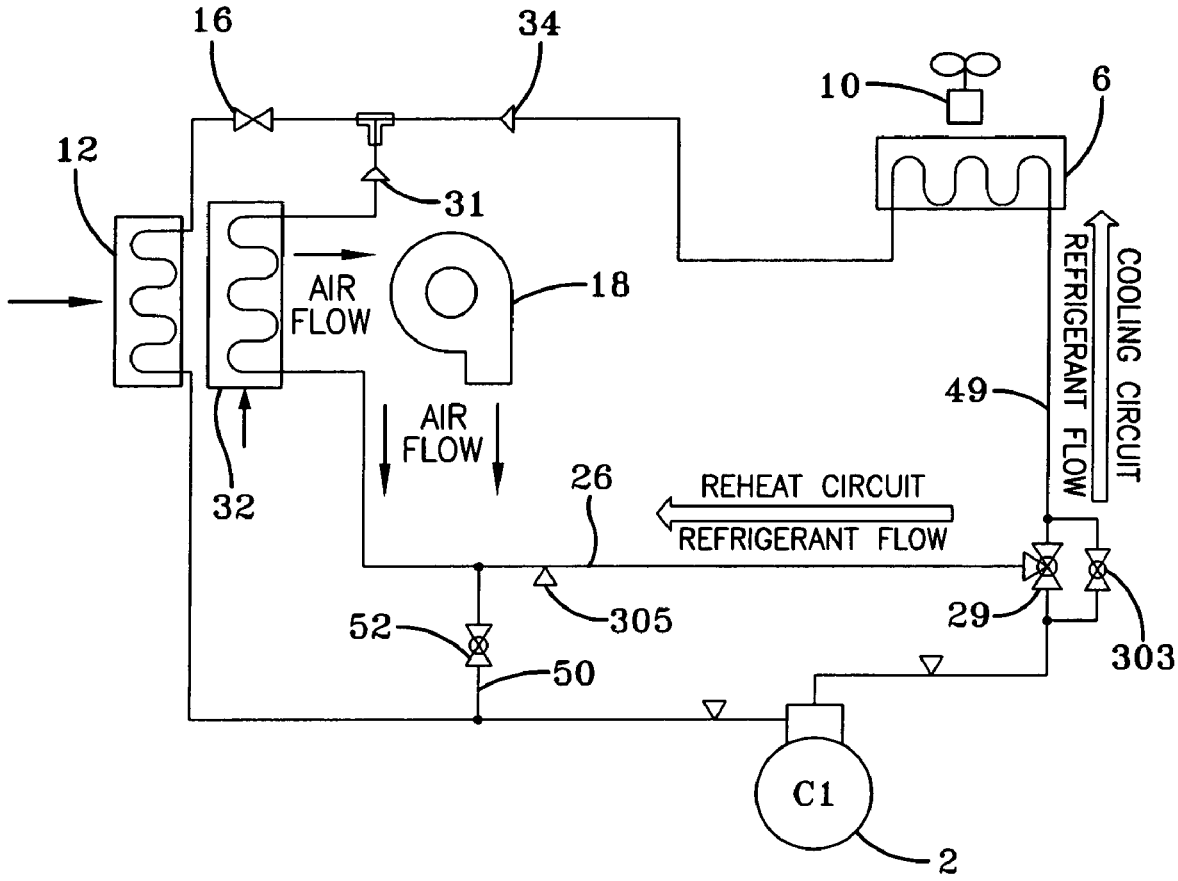
FIG. 3 is a schematic illustration of a second embodiment of the present invention with a second arrangement of solenoid valves to channel excess refrigerant into the inactive circuit.

In a second embodiment of the present invention, shown in FIG. 3, a conduit 301 connects the discharge side of compressor 2 to the discharge line 49 between between three-way valve 29 and condenser 6. In this embodiment, reheat high-pressure device 305 is positioned along the discharge line of compressor 2 between compressor 2 and reheat coil 32. As shown in FIG. 3, reheat high-pressure device 305 is positioned on the discharge line of compressor 2 between the compressor and three-way valve 29. In normal steady state operation, cooling circuit 49 acts in a conventional manner as described above. Similarly, reheat circuit 26 also acts in a conventional manner as described above.

In transition from the cooling mode to the reheat mode, three-way valve is switched to direct the refrigerant gas discharged from the discharge port of compressor 2 into reheat circuit 26. When the pressure detected by reheat high-pressure device 305 is above a first preselected limit, reheat-high pressure device 305 acts to open solenoid valve 303, thereby directing some refrigerant gas from the active reheat circuit to condenser 6. The operation of solenoid valve 303 is as described above. As refrigerant gas flows out of reheat circuit 26 and into storage in condenser coil 6, the discharge pressure from compressor 2 will decrease. When the pressure detected by reheat pressure device 305 falls below a second preselected limit, reheat high pressure device 305 acts to close solenoid valve 303, thereby stopping the flow of refrigerant out of the reheat circuit and into the cooling circuit where it is stored in the condenser. As before, on reaching the second preselected limit, the amount of refrigerant in reheat circuit 26 will be self-regulated to a level to permit efficient operation, and the risk of too much refrigerant being supplied to the compressor in the reheat mode is reduced, if not eliminated. Inasmuch as the pressure in the reheat circuit is related to the refrigerant evaporation temperature, by controlling the amount of refrigerant in the reheat circuit, the operating temperature of the evaporator and hence the amount of dehumidification provided by the evaporator to the air flowing through it can also be controlled.

Also shown in FIG. 3 is an alternate embodiment in which the reheat pressure device 305 positioned on the high pressure side of the compressor is replaced by reheat pressure device 307 which is located on the low pressure side, or suction side of the compressor. It will be understood that either reheat pressure device 305 or reheat pressure device 307 is operational in the system, as discussed for the embodiment shown in FIG. 2 in paragraph [0033] above. Reheat pressure device, when located in the suction line of compressor 2 between accumulator 309 and the suction port of compressor 2 operates as described above for the alternate, equivalent embodiment described in FIG. 2.

Figure 4:
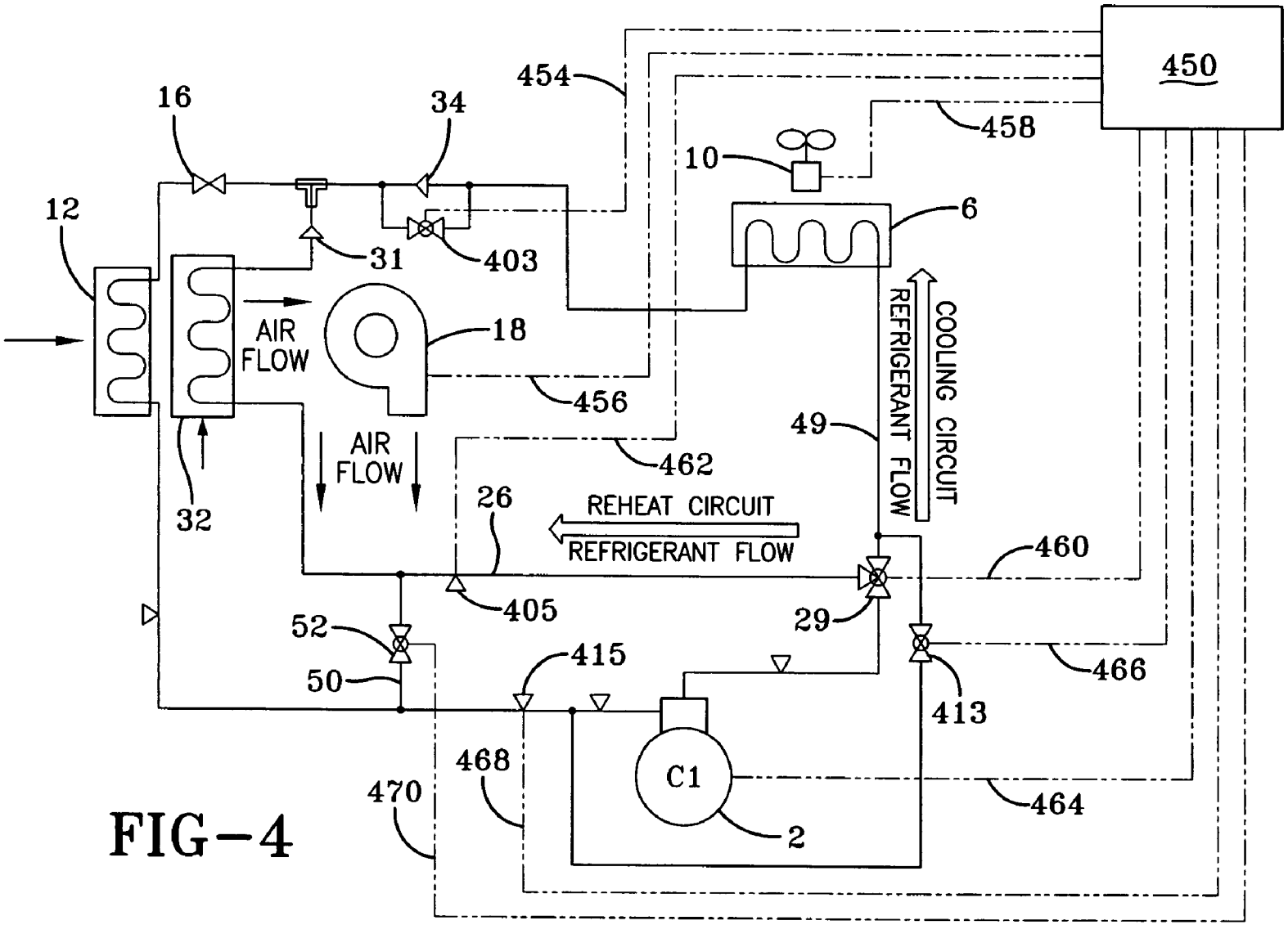
FIG. 4 is a schematic illustration of a third embodiment of the present invention with a third arrangement of solenoid valves to channel excess refrigerant into the inactive circuit.

FIG. 4 discloses yet another embodiment of the present invention. This embodiment is a system that utilizes independent reheat circuit 26 and an independent cooling circuit 49, both operating in the steady state as set forth above. Three-way valve 29 directs refrigerant to either cooling circuit 49 or reheat circuit 26 depending upon whether there is a demand for cooling or dehumidification in the space. The system of FIG. 4 includes a reheat refrigerant recovery circuit 50 that includes a solenoid valve 52 operating as described above to remove refrigerant from the reheat coil when the system switches from reheat to cooling. The system of FIG. 4 includes a third solenoid valve 403 positioned to bypass check valve 34 to allow refrigerant to flow from reheat coil 32 to condenser coil 6, as discussed above. The system also includes a fourth solenoid valve 413 positioned in a conduit that connects the low pressure or suction side of compressor 2 to condenser circuits 6, here shown connected to line 49, although a direct connection to condenser circuits is also within this embodiment. Valve 413 can be opened when three-way valve 29 is positioned to direct refrigerant flow to reheat circuit 26 and in response to pressure device 415. If the pressure drops below a preselected value, valve 413 is opened in response to the low pressure reading from pressure device 415 allowing refrigerant to be drawn back into the circuit until the refrigerant pressure is raised above a preselected value, at which time valve 413 is closed stopping the flow of refrigerant into the circuit.

A first pressure device 405 controls the operation of solenoid valve 403. The first pressure device 405 may be either a high pressure device positioned as shown in FIG. 4. Alternatively, pressure device 405 may be a low pressure device positioned on the low-pressure side of compressor 2, causing valve 403 to open or close in response to the pressure sensed on the suction or low-pressure side of the compressor. A second pressure device 415 controls the operation of solenoid valve 413. Again, second pressure device 415 may be either a low pressure device positioned as shown in FIG. 4, or alternatively a high pressure device positioned on the high pressure side of compressor 2 between three way valve 29 and expansion device 16. Preferably, when first reheat pressure device 405 is a high pressure device, second reheat pressure device 415 is a low pressure device. When the pressure in the system is determined by the high pressure sensor to be too high, valve 403 is opened and refrigerant is transferred to the condenser circuits 6 until the pressure is at or below a predetermined set point, at which time valve 403 is closed. If the pressure in the reheat circuit drops below a predetermined set point, as measured by pressure device 415, then solenoid valve 413 is opened and refrigerant is drawn by suction of the compressor from storage in the condenser circuits 6 back into reheat circuit. When the pressure rises to or above a preselected set point, as measured by device 415, valve 413 is closed.

The first pressure device 405 controls third reheat solenoid valve 403 in the manner that pressure device 205 and second solenoid valve 203 operate in the embodiment of FIG. 2, which removes refrigerant from the circuit when a high head pressure is detected. Pressure device 415 and solenoid valve 413 are configured similarly to the circuit described in the Knight application. They differ operationally. The circuit in the Knight application is operates by opening a solenoid valve such as valve 413 when the circuit is initially switched from a first mode to a second mode, such as cooling to reheat, in order to prevent refrigerant from being trapped in the inoperative circuit. This is essentially automatically accomplished when the mode is switched. In this application, solenoid valve 413 is operated only in response to a drop in pressure below a preselected value or setpoint as monitored by pressure device 415 as the reheat circuit is operating in the reheat mode. Of course, a sophisticated controller can be programmed to allow valve 413 to operate when switching from one mode to another mode occurs, and when required by sensed pressures by pressure device 415. In this circumstance, redundant hardware can be avoided.

Because the system of FIG. 4 monitors both the high pressure side of compressor 2 and the low pressure or suction side of compressor 2, the system of FIG. 4 can respond rapidly to achieve steady state operation when the pressure is either too high or too low. When solenoid valve 403 or solenoid valve 413 is controlled by a high-pressure device, the remaining solenoid valve is controlled by a low-pressure device. Thus, when the system of FIG. 4 switches from the cooling mode to the reheat mode, the system not only responds responds initially to remove refrigerant trapped in the condenser circuits 6, but quickly responds to remove refrigerant from the reheat circuit 26 when the refrigerant pressure on the exceeds a preselected pressure valve. It also corrects the refrigerant pressure when the refrigerant falls below a preselected pressure valve.

By a slight modification to the control functions of FIG. 4, which is best set out in the following description, a different embodiment of the present invention is set forth. Controller 450 is shown in communication with the various components of the system, which is generally true of all of the previously described embodiments. Controller 450 is also in communication with sensors in the space that is to be controlled or with a controller in that space, which is shown by the dashed lines of FIG. 4. Other related elements, as required, may also be in communication with controller 450, and the communications lines are not limited to the lines shown. The communications among the various components of the system of FIG. 4 may be via hard wiring between the components and the controller, or it may be by wireless communication, such as RF communications, or some combination. Any known or new method of communication among the components and the controller may be used, as long as reliable communications exist.

As set forth in FIG. 4, controller 450 monitors pressure device 405 and pressure device 415 in order to control the operation of third solenoid valve 403 and fourth solenoid valve 413, respectively. It will be understood by those skilled in the art that pressure device 405 and pressure device 415 alternatively may also be provided as switches to control the operation of valve 403 and valve 413.

In this embodiment, communications are shown between controller 450 and solenoid valve 403 via line 454; between controller 450 and blower 18 via line 456; between controller 450 and condenser fan 10 via line 458; between controller 450 and solenoid valve 29 via line 460; between controller 450 and first device 405 via line 462; between controller 450 and compressor 2 via line 464; between controller and solenoid valve 413 via line 466; between controller 450 and second device 415 via line 468 and between controller 450 and solenoid valve 52 via line 470. As shown, the controller 450 is also in communication with a controller or sensors in the space in which conditioned air is required.

When the space to which conditioned air is supplied requires cooling, a signal is sent to controller 450 from the space, either from a controller, or from a sensor, in which circumstance controller 450 includes programmable limits and the signal from the sensor indicates that the limits have been reached. This controller sends a signal along line 464 to activate compressor 2 if it is not already operating. Controller 250 sends a signal to three-way valve 29 to direct compressed refrigerant toward condenser 6. Controller also sends a signal to solenoid valve 52 via line 470, opening refrigerant recovery circuit 50. The suction action of compressor draws any refrigerant from reheat coil 32 into the cooling circuit. Solenoid valve 52 may remain open while the cooling circuit is activated, or it may be shut, such as by a time delay and/or another signal from controller 450. A signal is also sent to condenser fan 10 along line 458 and to blower 18 along line 456. Controller 450 also closes solenoid valves 403 and 413, if not already closed. The cooling circuit operates in a conventional manner supplying cooled, dehumidified air to the space.

When the space to which conditioned air is supplied indicates that the air exceeds a preselected humidity, such as when a cooling circuit is providing air that requires additional dehumidification, or when the cooling requirements have been met in the space, but the dehumidification requirements have not been met, a signal is sent from controller 450 to compressor 2 to activate compressor 2 if it is not already running. A signal is also sent along line 460 to three-way valve 29 to place it in a position to direct refrigerant gas into hot gas reheat circuit 26. Controller 450 also sends a signal to solenoid valve 52 to close it, if it is not already closed, so that hot refrigerant gas is not cycled to the suction side of compressor 2. Of course, a signal is sent along line 456 to activate blower 18 if it is not already running.

In the reheat mode, first device 405 and second device 415 control the operation of third solenoid valve 403 and fourth solenoid valve 413 respectively. As shown in FIG. 4, first device 405 and second device 415 are in communication with controller 450. Controller 450 is programmed with set points that initiate an action when the set points are reached. However, as noted above, first and second device 405, 415 may include switches that are activated to control valves 403, 413 when the set points are reached. In this embodiment, when the reheat circuit is activated, one of first and second devices 405, 415 opens one of valves 403, 413 to open the valve to move refrigerant into condenser coil 6. This valve is closed when a preselected pressure is reached. The remaining device monitors the pressure in the system and opens the remaining valve to maintain a preselected pressure in reheat circuit 26. When the preselected pressure is reached, the controller, which is monitoring the sensor, sends a signal closing the remaining valve.

To further illustrate this example, on switching to reheat mode, a reheat high pressure sensor 405 sends a signal to controller 450 along line 462 indicative of the presence of high pressure refrigerant gas is flowing in reheat circuit 26. Controller 450 sends a signal along line to solenoid valve 403, opening it, allowing refrigerant to flow into condenser circuits 6. Reheat sensor 415 provides a signal to controller 450 indicative of the pressure in the suction line of compressor 2. If the pressure in the line is above a predetermined limit, the controller 450 maintains solenoid valve 413 in a closed position. However, if the pressure falls below a predetermined limit, as determined by controller 450 which is monitoring the signal from pressure sensor 415 along line 468, a signal is sent by controller 450 to solenoid valve 413, opening it and allowing refrigerant to be drawn from condenser circuits 6 into reheat circuit 26 by the suction of compressor 2. When pressure sensor 415 indicates to controller 450 that the pressure has risen sufficiently, again to a predetermined limit, controller 450 sends a signal along lines 460 and 454 lines 454 to close solenoid valve 413.

As may be clear, it is possible to control the operation of both valves 403 and 413 with a single sensor. In this case, the activation of the reheat circuit 26 (or inactivation of the cooling circuit 49) results in the opening of valve 403. Valve 413 is controlled as set forth above. Either valves is closed by controller 450 in response to a signal from the sensor indicating that the pressure is within a preselected range. For example, if the sensor indicates a high pressure, the controller can send a signal to effect operation of valve 403 until the pressure is reduced, at which time valve 403 is closed. Similarly, if a low pressure is indicated by the sensor, the controller can similarly effect operation of valve 413.

The arrangement of FIG. 4 with the use of a sophisticated controller or control program can result in a very complex system operation, which is beyond the scope of the present invention. It must be considered, however, that a series of sensors can be set up to detect conditions of the air. These sensed conditions can be of the return air or the supply air or both, and can include, for example, humidity or temperature. The control program can assess the sensor signals to determine whether the air is being properly dehumidified and/or warmed after passing through the system. Based on the sensed conditions, the control program can determine the set points required for operation of valves 403, 413 in order to obtain proper dehumidification and reheat. The amount of refrigerant in the reheat circuit can be adjusted to provide the proper refrigerant evaporation temperature in the evaporator, which is related to system pressure. Although the operational details of such a complex system are beyond the scope of the present disclosure, the mechanical arrangement of FIG. 4 make such a complex yet efficient system possible.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system having a hot gas reheat circuit and a cooling circuit comprising:

the cooling circuit comprising:

a compressor having a high-pressure discharge side and a low-pressure suction side, the compressor in fluid communication with a condenser, an evaporator in fluid communication with the condenser and with the compressor, an expansion device between the condenser and the evaporator, and a check valve to prevent the back flow of refrigerant into the condenser from a downstream side of the condenser;

the hot gas reheat circuit comprising:

the compressor having a high-pressure discharge side and a low-pressure suction side, the compressor in fluid communication with a reheat heat exchanger, the evaporator in fluid communication with the reheat heat exchanger and with the compressor, an expansion device between the reheat heat exchanger and the evaporator, and a check valve to prevent the back flow of refrigerant into the reheat heat exchanger from the cooling circuit when the cooling circuit is activated;

the system further including a first means for controlling a flow of a refrigerant in fluid communication with the discharge side of the compressor and switchable between a first position in which high pressure refrigerant flows through the hot gas reheat circuit and is blocked from flowing to cooling circuit and a second position in which the refrigerant flows to the cooling circuit and is blocked from entering the reheat circuit;

means for directing air from a space across the evaporator to cool and dehumidify the air and, when activated, the reheat exchanger to reheat the air;

a cooling by-pass circuit providing fluid communication between the suction side of the compressor and the reheat heat exchanger including a second means for controlling the flow of remaining refrigerant out of the hot gas reheat circuit and switchable from a first position in which refrigerant flows from the hot gas reheat circuit when the first means for controlling is positioned to direct refrigerant to the cooling circuit and a second position in which the flow of refrigerant is blocked from leaving the hot gas reheat circuit when the first means for controlling is positioned to direct refrigerant to the reheat circuit; and a third means for transferring excess refrigerant from the reheat circuit to the condenser in the cooling circuit in response to a preselected condition in the hot gas reheat circuit when the first means for controlling is positioned to direct refrigerant to the hot gas reheat circuit.

2. The system of claim 1 having the hot gas reheat circuit and the cooling circuit, one of which circuits includes the compressor, further including a second compressor in the remaining circuit.

3. The system of claim 1 wherein the system includes a single expansion device the single expansion device positioned within the system on the upstream side of the evaporator, the hot gas reheat circuit utilizing the compressor, the expansion device and the evaporator when refrigerant is directed by the first means to the hot gas reheat circuit and the cooling circuit utilizing the compressor, the expansion device and the evaporator when refrigerant is directed by the first means to the cooling circuit.

4. The system of claim 3 wherein the third means transferring excess refrigerant includes a sensor for detecting a condition within the reheat circuit and a third valve responsive to a signal from the sensor indicative of the condition.

5. The system of claim 4 wherein the first means for controlling the flow of refrigerant from the discharge side of the compressor between hot gas reheat circuit and the cooling circuit is a first valve.

6. The system of claim 5 wherein the second means for controlling the flow of excess refrigerant is a solenoid valve.

7. The system of claim 5 wherein the first valve is a three way valve.

8. The system of claim 4 further including a controller that controls the operation of the first means, the second means and the third means.

9. The system of claim 8 wherein the controller operates:

the first means, the first means being a first valve that selectively directs the flow of refrigerant discharged from the compressor between the hot gas reheat circuit and the cooling circuit;

the second means, the second means being a solenoid valve selectively operable between a closed position when the first valve directs the flow of refrigerant to the hot gas reheat circuit and an open position when the first valve directs the flow of refrigerant to the cooling circuit, and the third means being a third valve operable in response to a signal from the sensor indicative of a sensed condition.

10. The system of claim 9 wherein the sensed condition is a refrigerant pressure in the hot gas reheat circuit and the controller opens the third valve in response to a signal from the sensor, the signal indicative that the pressure exceeds a preselected value, and the controller closes the third valve in response to the signal from the sensor indicative that the pressure is below a preselected value, wherein refrigerant is removed from the hot gas reheat circuit to the condenser when the third valve is open, the cooling circuit that includes the condenser being inactive.

11. The system of claim 4 wherein the third valve is positioned to bypass the check valve that prevents the back flow of refrigerant to the condenser.

12. The system of claim 11 wherein the third valve is positioned between the expansion device and the condenser.

13. The system of claim 4 wherein the sensor detects pressure in the hot gas reheat circuit.

14. The system of claim 13 wherein the sensor detects pressure in the hot gas reheat circuit and the controller opens the third valve in response to a signal from the sensor indicating that the pressure exceeds a first preselected value, and closes the valve in response to a signal from sensor that the pressure is below a second preselected value.

15. The system of claim 14 wherein the detected pressure is a discharge pressure.

16. The system of claim 14 wherein the detected pressure is a suction pressure.

17. The system of claim 14 wherein the first preselected value and the second preselected value are equal.

18. The system of claim 14 wherein the first preselected value is greater than the second preselected value.

19. The system of claim 4 wherein the third valve is positioned to bypass the first valve that prevents the flow of refrigerant from the discharge side of the compressor to the cooling circuit when the hot gas circuit is activated so that excess refrigerant is directed to the condenser.

20. The system of claim 19 wherein the sensor detects pressure in the hot gas reheat circuit and the controller opens the third valve in response to a signal from the sensor indicating that the pressure exceeds a first preselected value, and closes the valve in response to a signal from sensor that the pressure is below a second preselected value.

21. The system of claim 19 wherein the detected pressure is a discharge pressure.

22. The system of claim 19 wherein the detected pressure is a suction pressure.

23. The system of claim 19 wherein the first preselected value and the second preselected value are equal.

24. The system of claim 19 wherein the first preselected value is greater than the second preselected value.

25. The system of claim 3 wherein the third means for controlling the transfer of excess refrigerant is a switch-operable valve, the switch opening the valve when a condition exceeds a preselected limit and closing the valve when the condition does not exceed a preselected limit.

26. The system of claim 25 wherein the condition is a pressure.

27. The hot gas reheat circuit of claim 26 wherein the first means for controlling the flow of refrigerant into the circuit is a first valve switchable between a first position in which refrigerant is directed through the circuit and a second position in which refrigerant is directed to the condenser.

28. The system of claim 27 wherein the second means for controlling the flow of excess refrigerant is a solenoid valve.

29. The system of claim 27 wherein the first valve is a three way valve.

30. The system of claim 27 wherein the switch-operable valve is positioned to bypass the check valve that prevents the back flow of refrigerant to the condenser.

31. The system of claim 27 wherein the switch-operable valve is positioned between the expansion device and the condenser.

32. The system of claim 27 wherein the detected pressure is a discharge pressure.

33. The system of claim 27 wherein the detected pressure is a suction pressure.

34. The system of claim 26 wherein the switch-operable valve is positioned to bypass the first valve that prevents the flow of refrigerant from the discharge side of the compressor to the cooling circuit when the hot gas circuit is activated so that excess refrigerant is directed to the condenser.

35. The system of claim 34 wherein the pressure is a discharge pressure.

36. The system of claim 34 wherein the pressure is a suction pressure.

37. The system of claim 1 further including a fourth means for transferring excess refrigerant stored in the condenser to the hot gas reheat circuit in response to a preselected condition in the hot gas reheat circuit.

38. The system of claim 37 wherein the fourth means is a switchable valve positioned between the condenser and the low-pressure suction side of the compressor, the switchable valve opening when the pressure in the hot gas reheat circuit falls below a preselected value.

39. The system of claim 37 further including a controller wherein the controller controls:

the first means wherein the first means is a first valve selectively directing the flow of refrigerant discharged from the compressor to one of the hot gas reheat circuit and the cooling circuit;

the second means wherein the second means is solenoid valve selectively operable between a closed position wherein the first valve directs the flow of refrigerant to the hot gas reheat circuit and an open position wherein the first valve directs the flow of refrigerant to the cooling circuit, the third means wherein the third means is a third valve operable in response to a signal from a sensor indicative of a first sensed condition, and the fourth means for transferring excess refrigerant stored in the condenser to the hot gas reheat circuit in response to a second sensed condition in the hot gas reheat circuit.

40. The system of claim 39 wherein the fourth means includes a second sensor and a fourth valve.

41. The system of claim 40 wherein the fourth means wherein the second sensor detects a second condition within the reheat circuit and the fourth valve operates responsive to a signal from the second sensor indicative of the second condition.

42. The system of claim 41 wherein the first sensed condition is a refrigerant pressure in the hot gas reheat circuit and the controller opens the third valve in response to a signal from the sensor, the signal indicative that the pressure exceeds a first preselected value and closes the third valve in response to- the signal from the first sensor that the pressure is below a second preselected value wherein refrigerant is moved from the hot gas reheat circuit to the condenser when the third valve is open, and wherein the second sensed condition is a refrigerant pressure in the hot gas reheat circuit and the controller opens the fourth valve in response to a signal from the second sensor, the signal indicative that the pressure is below a third preselected value and closes the fourth valve in response to the signal from the second sensor that the pressure is above a fourth preselected value, wherein refrigerant is moved from the condenser to the hot gas reheat circuit when the fourth valve is open, the first preselected value being greater than the second preselected value, the third preselected value being less than the fourth preselected value, and the first and second preselected values being greater than the third and fourth preselected values.

43. A method of providing conditioned air to an interior space of a building, the method comprising the steps of:

providing a first cooling circuit comprising:

a compressor having a high-pressure discharge side and a low-pressure suction side, the compressor in fluid communication with a condenser, an evaporator in fluid communication with the condenser and with the compressor, an expansion device between the condenser and the evaporator, and a check valve to prevent the back flow of refrigerant into the condenser from a downstream side of the condenser;

providing a hot gas reheat circuit comprising:

a compressor having a high-pressure discharge side and a low-pressure suction side, the compressor in fluid communication with a reheat heat exchanger, an evaporator in fluid communication with the reheat heat exchanger and with the compressor, an expansion device between the condenser and the evaporator, and a check valve to prevent the back flow of refrigerant into the reheat heat exchanger from the cooling circuit when the cooling circuit is activated;

providing a first means for controlling a flow of a refrigerant in fluid communication with the discharge side of the compressor and switchable between a first position in which high pressure refrigerant flows through the hot gas reheat circuit and is blocked from flowing to cooling circuit and a second position in which the refrigerant flows to the cooling circuit and is blocked from entering the reheat circuit;

providing means for directing air from a space across the evaporator to cool and dehumidify the air and, when activated, the reheat exchanger to reheat the air;

providing a cooling by-pass circuit having fluid communication between the suction side of the compressor and the reheat heat exchanger including a second means for controlling the flow of remaining refrigerant out of the hot gas reheat circuit and switchable from a first position in which refrigerant flows from the hot gas reheat circuit when the first means for controlling is positioned to direct refrigerant to the cooling circuit and a second position in which the flow of refrigerant is blocked from leaving the hot gas reheat circuit when the first means for controlling is positioned to direct refrigerant to the reheat circuit;

providing a third means for controlling the transfer of excess refrigerant from the reheat circuit to the condenser in the cooling circuit when the first means for controlling is positioned to direct refrigerant to the reheat circuit;

directing excess refrigerant from the hot gas reheat circuit through the third means to the condenser when the hot gas reheat circuit is activated and the cooling circuit is inactivated and a sensed condition in the reheat circuit exceeds a first preselected value, and terminating the flow of excess refrigerant from the hot gas reheat circuit through the third means when the sensed condition in the reheat circuit falls below a second preselected value.

* * * * *

UNITED STATES PATENT AND TRADEMARK OFFICE

CERTIFICATE OF CORRECTION

PATENT NO. : 7,219,505 B2
APPLICATION NO. : 10/970958
DATED : May 22, 2007
INVENTOR(S) : Weber et al.

It is certified that error appears in the above-identified patent and that said Letters Patent is hereby corrected as shown below:

Col. 16, Line 26: "response to- the signal" should be --response to the signal--

Signed and Sealed this

Seventh Day of August, 2007

JON W. DUDAS
*Director of the United States Patent and Trademark Office*